US009803462B2

(12) United States Patent
Ocalan et al.

(10) Patent No.: US 9,803,462 B2
(45) Date of Patent: Oct. 31, 2017

(54) REDUCING AXIAL WAVE REFLECTIONS AND IDENTIFYING STICKING IN WIRELINE CABLES

(71) Applicant: SCHLUMBERGER TECHNOLOGY CORPORATION, Sugar Land, TX (US)

(72) Inventors: Murat Ocalan, Houston, TX (US); Jahir Pabon, Newton, MA (US); Daniel Palmer, Clamart (FR); Hitoshi Tashiro, Paris (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 19 days.

(21) Appl. No.: 14/796,145

(22) Filed: Jul. 10, 2015

(65) Prior Publication Data

US 2015/0308256 A1 Oct. 29, 2015

Related U.S. Application Data

(62) Division of application No. 13/338,068, filed on Dec. 27, 2011, now Pat. No. 9,133,676.

(51) Int. Cl.

| | |
|---|---|
| ***E21B 47/00*** | (2012.01) |
| ***E21B 23/14*** | (2006.01) |
| ***E21B 19/08*** | (2006.01) |
| ***E21B 31/00*** | (2006.01) |

(52) U.S. Cl.

CPC ..... *E21B 47/00* (2013.01); *E21B 19/08* (2013.01); *E21B 23/14* (2013.01); *E21B 31/005* (2013.01); *E21B 47/0006* (2013.01)

(58) Field of Classification Search

CPC ..... E21B 23/14; E21B 19/08; E21B 47/00; E21B 47/0006; E21B 31/005

See application file for complete search history.

(56) References Cited

U.S. PATENT DOCUMENTS 4,282,523 A * 8/1981 Youmans ..... E21B 19/22 340/854.1

2013/0160995 A1 6/2013 Ocalan et al.

* cited by examiner

*Primary Examiner* — Yong-Suk (Philip) Ro

(74) *Attorney, Agent, or Firm* — Bridget M. Laffey

(57) ABSTRACT

Techniques for axial vibration control of wireline tools and cables during logging operations. In undesirable cases the axial vibrations may lead to or exasperate the stick-slip problems of the logging tool. Control systems and strategies to minimize vibrations and techniques for identifying and inhibiting the sticking of the cable. A system includes a surface actuator and a sensor. The actuator generates an axial wave on the wireline cable which travels down the cable. If there is sticking of the cable, a reflection can also occur at the location of sticking. This shift in the transmission of the wave on the wireline cable is used to identify the onset and/or presence of sticking.

15 Claims, 13 Drawing Sheets

Case 1: no sticking
Time = 0.9 s

1410
Time = 1.8 s

1420
Time = 2.7 s

1430
Time = 3.6 s

1440
Force (N)
Depth (m)
0
20
40
60
1000
2000
3000
4000

Case 2: sticking at 2000m
Time = 0.9 s

1510
Time = 1.8 s 1520
1522
Time = 2.7 s 1530
1532
Time = 3.6 s 1540
1542
Force (N)
Depth (m)
0
20
40
60
1000
2000
3000
4000

REDUCING AXIAL WAVE REFLECTIONS AND IDENTIFYING STICKING IN WIRELINE CABLES

CROSS REFERENCE TO RELATED APPLICATIONS

This application is a divisional of U.S. patent application Ser. No. 13/338,068, filed Dec. 27, 2011.

FIELD

The subject disclosure relates to the field of wireline tools deployed in a borehole. More specifically, the subject disclosure relates to techniques for reducing axial wave reflections and identifying sticking in wireline cables used for deploying tools in a borehole.

BACKGROUND

Adherence (sticking) of wireline cables to borehole walls is an undesirable phenomenon that can lead to operational issues in the delivery of wireline service. In its extreme form the adhering force can exceed the cable breaking force and lead to loss of tools downhole. In problematic logging conditions, the cable sticking occurs while taking stationary measurements during which the cable resting on the side of the borehole lead to a reduction in pressure directly underneath it, commonly called differential sticking.

The current surface drive system for wireline operations commonly utilize a hydraulic pump driven by an internal combustion engine. The pressurized hydraulic oil from the pump is directed to a hydraulic motor which in turn drives the winch. Normally the control mechanism for this system allows for the operator to control the hydraulic oil pressure. This pressure control is roughly equivalent to controlling tension on the cable. Also for the systems that are equipped with a tension gauge, the operator has direct access to the real-time tension data at surface. The sensor for measuring the tension can be placed on the cable, such as the Cable Mounted Tension Device (CMTD) system from Schlumberger, or can be placed between a sheave and its hook, such as Schlumberger's Sheave-Mounted Tension Device Link. For further details of the CMTD system, see US Patent Application Publ. No. 2010/0262384, which is incorporated by reference herein.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In accordance with some embodiments a method and a system are provided for reducing axial wave reflections in a wireline tool cable. The method includes deploying a wireline tool in a borehole using a cable; making a measurement relating to a physical cable parameter, such as cable tension and/or cable motion; and reducing reflections of axial waves propagating through the cable by controlling an actuator, based at least in part on the measurement.

According to some embodiments the actuator is located on the surface such as on the wireline winch, or a sheave. The control can include a combination of feedforward and proportional control of cable velocity of the cable, or a derivative control of cable velocity. According to some embodiments, the reflections are considerably reduced while still allowing surface control over the position of the wireline tool.

According to some embodiments, a system is provided for reducing axial wave reflections in a wireline tool cable. The system includes a wireline tool, a wireline cable deployed in a borehole, a measurement system adapted to make a measurement of the physical parameter of the cable, an actuator adapted to impart a force upon the cable and a control system adapted to control the actuator based at least in part on measurements from the measurement system such that reflection of axial waves propagating through the cable are reduced.

According to some embodiments, a method and system are provided for detecting sticking of a wireline tool cable deployed in a borehole. The method includes deploying a wireline tool in a borehole using a cable; inducing an axial wave propagating along the cable; making measurements of the induced axial wave; and detecting a parameter relating to sticking of the cable, such as the onset of sticking or the location of sticking, within the borehole based on the measurements. According to some embodiments, a baseline measurement is made following a recent repositioning of the wireline tool within the borehole; and subsequent measurements are compared to the baseline measurement, the detecting sticking based on the comparison.

According to some embodiments a system and method are also provided for inhibiting sticking of a wireline tool cable within a borehole. The method includes actuating the cable to induce an axial wave propagating along the cable so as to inhibit sticking of the cable within the borehole. According to some embodiments, axial oscillatory motion along the cable is induced.

Further features and advantages will become more readily apparent from the following detailed description when taken in conjunction with the accompanying Drawings.

DETAILED DESCRIPTION

Specific details are given in the following description to provide a thorough understanding of the embodiments. However, it will be understood by one of ordinary skill in the art that the embodiments may be practiced without these specific details. For example, systems, processes, and other elements in the invention may be shown as components in block diagram form in order not to obscure the embodiments in unnecessary detail. In other instances, well-known processes, structures, and techniques may be shown without unnecessary detail in order to avoid obscuring the embodiments. Further, like reference numbers and designations in the various drawings indicate like elements.

Also, it is noted that individual embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process may be terminated when its operations are completed, but could have additional steps not discussed or included in a figure. Furthermore, not all operations in any particularly described process may occur in each embodiment. A process may correspond to a method, a function, a procedure, a subroutine, a subprogram, etc. When a process corresponds to a function, its termination corresponds to a return of the function to the calling function or the main function.

Furthermore, embodiments of the invention may be implemented, at least in part, either manually or automatically. Manual or automatic implementations may be executed, or at least assisted, through the use of machines, hardware, software, firmware, middleware, microcode, hardware description languages or any combination thereof. When implemented in software, firmware, middleware or microcode, the program code or code segments to perform the required tasks may be stored in a machine readable medium. A processor(s) may perform the required tasks.

According to some embodiments techniques are provided for axial vibration control of wireline tools and cables during logging operations. In undesirable cases the axial vibrations may lead to or exasperate the stick-slip problems of the logging tool. According to some embodiments, control systems and strategies to minimize vibrations are described.

Figure 1:
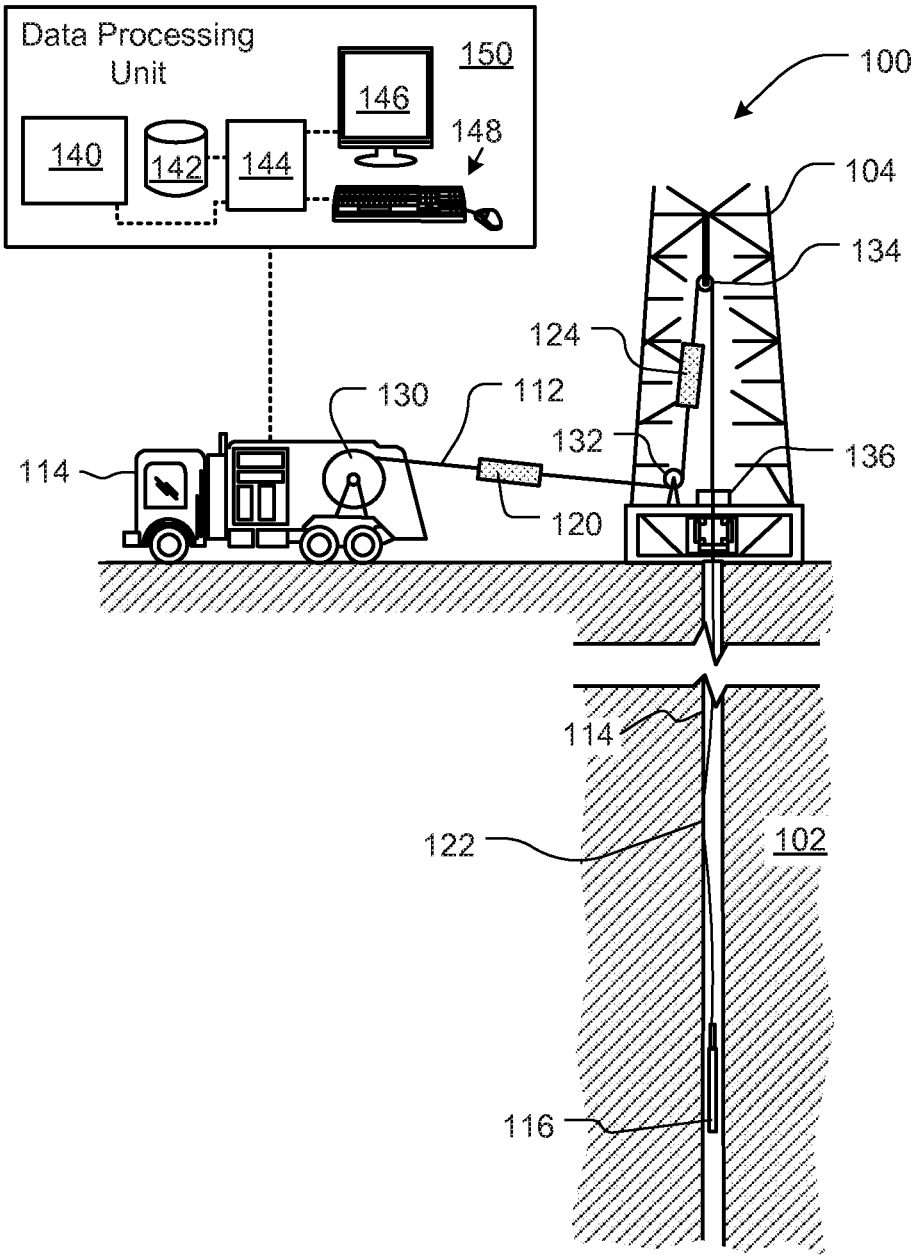
FIG. 1 illustrates a wellsite setting of a wireline tool deployment where cable sticking can be reduced, according to some embodiments.

FIG. 1 illustrates a wellsite setting of a wireline tool deployment where cable sticking can be reduced, according to some embodiments. Wellsite 100 has wellbore 114 penetrating a subterranean rock formation 102. A wireline tool (or toolstring) 116 is being deployed via wireline cable 112 from wireline truck 114. The truck includes a winch 130 that is used to control the depth of the wireline tool via cable 112. Cable 112 pass from the winch 130 to a lower sheave 132 and then to an upper sheave 134 on rig 104 before passing through well head 136 and into wellbore 114. Shown in the this case is a differential sticking location 122 where the cable 112 is being forced to the borehole wall by different pressure between the wellbore 114 and the formation 102 at location 122. Axial vibrations can also occur along cable 112 which if not controlled will reflect back and forth along the length of the cable 112. Also shown in FIG. 1 are auxiliary devices 120 and 124 that are mounted on cable 112. According to some embodiments the device 120 is an on-cable tension monitoring device, and device 124 is an on-cable tension generating device. Note that according to some embodiments the positions of devices 120 and 124 are switched, or alternately they can be collocated in one of the positions shown.

A data processing unit 150 is included, which according to some embodiments, is located within logging truck 114 and according to other embodiments is partially or fully located at other locations at the wellsite or one or more remote locations. The data processing unit 150 receives the measurements from the logging tool 116, and cable tension monitoring device 120 and other transducers as will be described herein. Processing unit 150 is adapted and programmed to carry out the vibration reduction, sticking monitoring and other monitoring and control techniques described herein. The data processing unit 150 includes one or more central processing units 140, storage system 144, communications and input/output modules 140, a user display 146 and a user input system 148.

Figure 2:
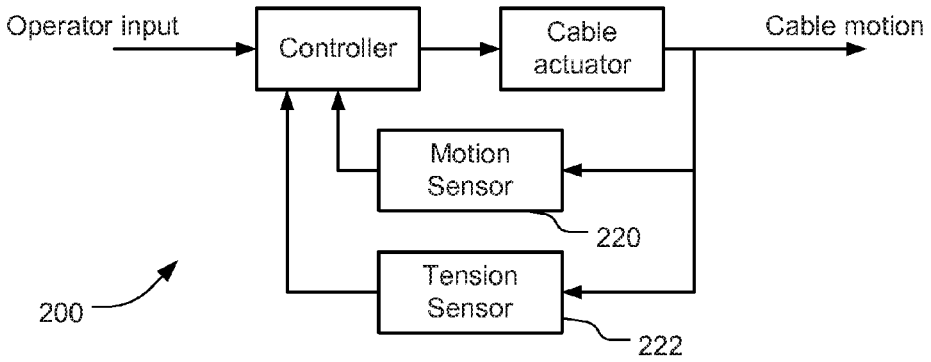
FIG. 2 is a block diagram illustrating aspects of a control system for reducing and/or minimizing wireline cable and tool vibrations, according to some embodiments.

According to some embodiments, further detail for a control system will now be described whose aim is to reduce and/or minimize axial vibrations of a wireline tool. According to one embodiment, this is achieved by reducing and/or minimizing reflections of axial waves from the surface equipment. FIG. 2 is a block diagram illustrating aspects of a control system for reducing and/or minimizing wireline cable and tool vibrations, according to some embodiments. The control system 200 utilizes data from transducer(s) 220 sensing cable motion. Examples of such transducers include an encoder wheel, angular velocity sensor, and an accelerometer. According to some embodiments, the control system 200 also utilized data from tension sensor 222, which can be for example an on-cable tension monitoring device such as described in U.S. Patent Application Publ. No. 2010/0262384.

Figure 3:
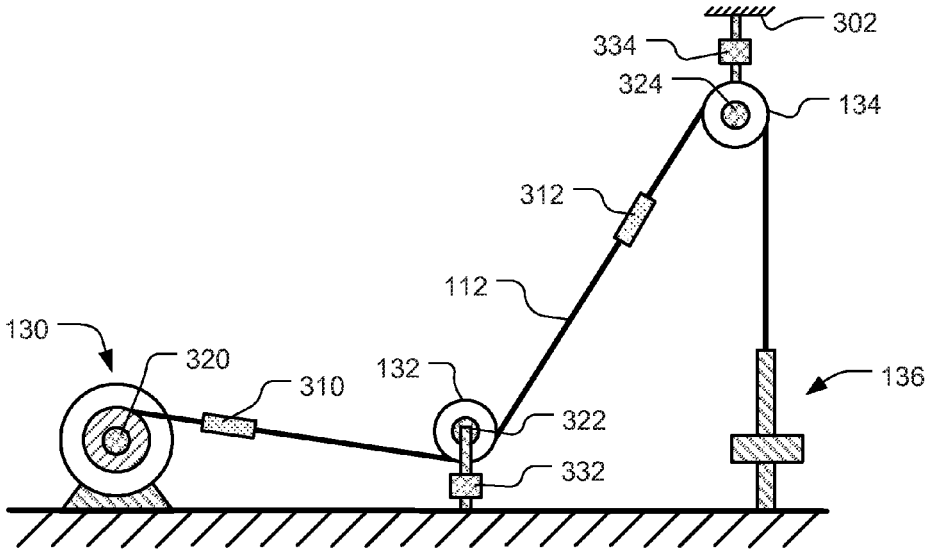
FIG. 3 is a schematic diagram of common surface equipment including various sensors and transducers that may be used by a control system for reducing and/or minimizing wireline cable and tool vibrations, according to some embodiments.
Figure 10:
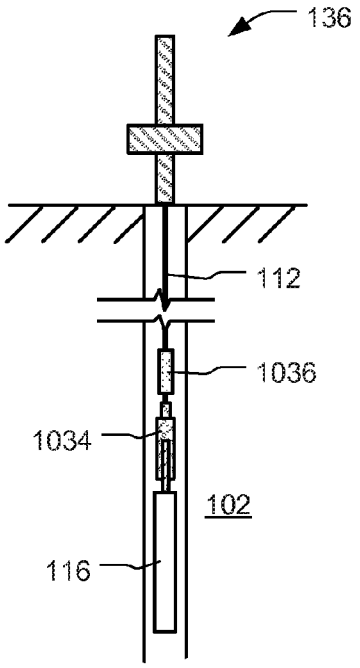
FIG. 10 illustrates a system having an actuator placed between the cable and the logging tool, according to an alternate embodiment.

According to some embodiments, the cable vibrations are minimized by utilizing a control system on the winch drive. FIG. 3 is a schematic diagram of common surface equipment including various sensors and transducers that may be used by a control system for reducing and/or minimizing wireline cable and tool vibrations, according to some embodiments. Winch 130 includes a rotation sensor 320. According to some embodiments, cable tension generating device 310 is provided for use in identifying the onset of cable sticking, as is described herein. The lower sheave 132 can include a rotation sensor 322 as well as an on-sheave tension monitoring device 332. An on-cable tension monitoring device 312 can be mounted on cable 112. The upper sheave 134 can include a rotation sensor 324 and/or an on-sheave tension monitoring device 334. Note that not all of the sensors and transducers shown in FIG. 3 will be used; rather FIG. 3 simply illustrates various types of sensors and locations that might be used alone or in combination with others, according to embodiments. One sensor which is not illustrated in the figure but may be used by the control system is the motion sensor placed on the logging tool, such as an accelerometer, for example, as shown in FIG. 10. Furthermore, the tension sensor 312 may be placed in the wellbore including on the logging tool.

Figure 4:
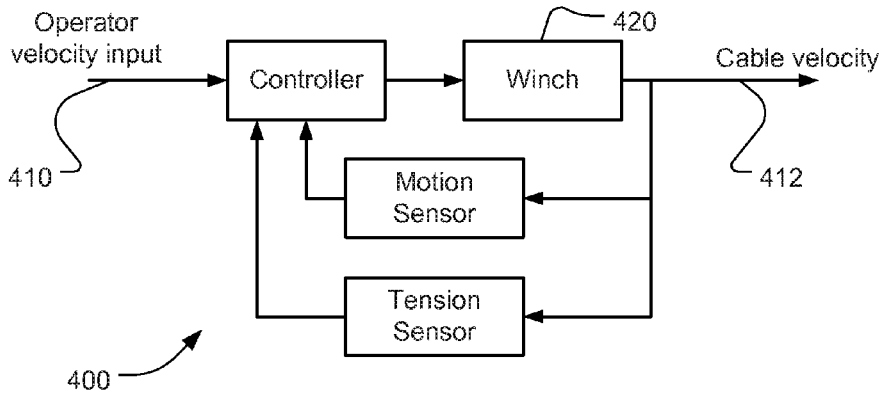
FIG. 4 is a block diagram showing various components of a winch control system for reducing and/or minimizing wireline cable and tool vibrations, according to some embodiments.
Figure 5:
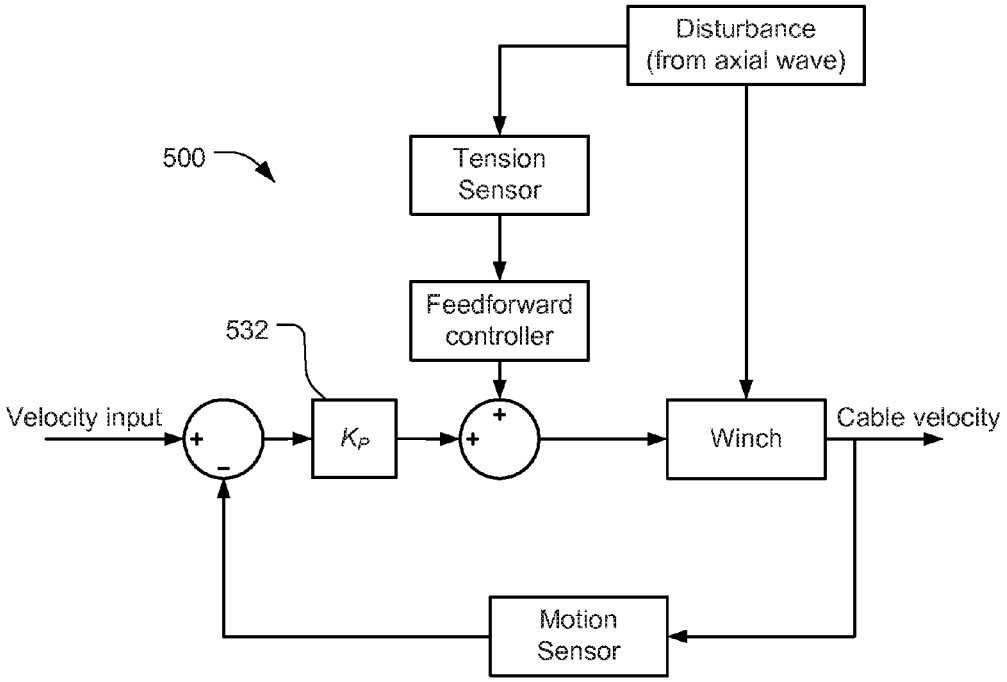
FIG. 5 is a block diagram of a control strategy for reducing axial wave reflections, according to some embodiments.
Figure 6:
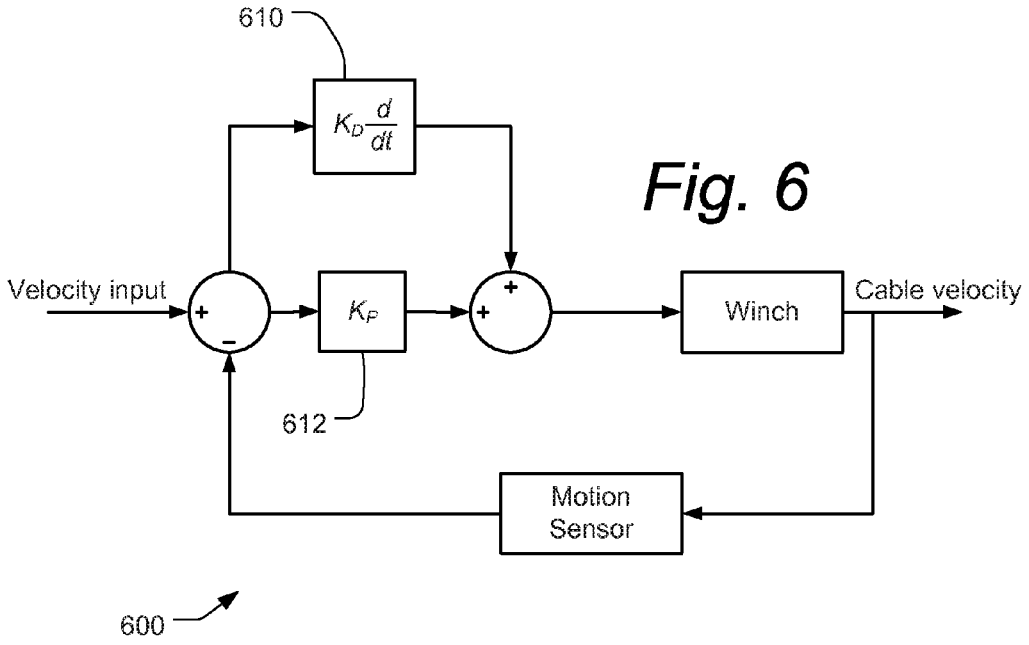
FIG. 6 is a block diagram of another control strategy for reducing axial wave reflections, according to some embodiments.

FIG. 4 is a block diagram showing various components of a winch control system for reducing and/or minimizing wireline cable and tool vibrations, according to some embodiments. The control system 400 is a more specific case of the general control system 200 of FIG. 2. In this case the cable actuator is a winch 420, the operator input is the velocity input 410 and the cable motion is cable velocity 412. Analytical calculations and numerical models can be used to select a control strategy suitable for the expected operating setup and conditions. According to some embodiments, two control strategies that have been found suitable for employment for a typical set up are illustrated in FIGS. 5 and 6. FIG. 5 is a block diagram of a control strategy for reducing axial wave reflections, according to some embodiments. Control system 500 is a feedforward + proportional control of cable velocity, where controller 532 is a proportional feedback controller. FIG. 6 is a block diagram of another control strategy for reducing axial wave reflections, according to some embodiments. Control system 600 uses proportional+ derivative control of cable velocity, where controller 612 is a proportional feedback controller, and controller 610 is a derivative feedback controller.

One of the feedforward controllers which was found to provide good vibration reduction represented in the time domain functional form is:

$$f_{FF} = K_{FD} \cdot \frac{d}{dt}$$

where $K_{FD}$ is the derivative feedforward gain and d/dt represents a first order derivative with respect to time.

To study the suitability of the control systems, a wireline string including 3000 meters of cable carrying an average sized wireline tool was modeled using a finite difference model. FIGS. 7A-D and FIGS. 8A-D are plots showing the simulation results for a surface velocity that is rapidly imposed at the surface, according to some embodiments. In FIGS. 7A-D, plots 710, 720, 730 and 740 show the cable velocity versus depth in the case the surface winch system does not have a controller for reducing axial wave reflections. The surface speed of a stationary cable and wireline tool is rapidly increased starting at t=0. A sizeable wave reflection is observed in both the tool and at the surface. These vibrations do not allow for a tool to achieve a constant speed at desirable time scales. As can be seen, the axial waves travelling up the cable are reflected which further disturbs the logging tool speed and impedes on reaching a constant logging speed. In comparison, plots 810, 820, 830 and 840 in FIGS. 8A-D show simulation results for a system with a tuned proportional and feedforward controller. As can be seen from FIGS. 8A-D, the axial reflection can be eradicated and the logging tool reaches a constant speed rapidly.

According to some embodiments, the following can be used to calculate zero reflection gains:

$$K_P = \sqrt{EA\mu}$$

$$K_{FD} = \frac{M}{\sqrt{EA\mu}}$$

Where E is Young's modulus of the cable; A is the cross-sectional area of the cable; μ is the mass per unit length of the cable; M is the equivalent inertia of the winch calculated by $$M = \frac{I}{r_w^2};$$

I is the rotational inertia of the winch; and $r_w$ is the radius of the winch at the initial cable contact towards the well.

It has been found that there is an inherent trade-off between reducing reflections and maintaining responsive surface control over the tool depth. Accordingly, in some cases it may not be desirable to completely eradicate axial reflections. There are a large number of control alternatives which will lead to a desired 'realistic' controller, i.e., one which will have reduced axial reflection from surface while still maintaining suitable surface control over the tool. In an actual implementation of the control system in some cases it is desirable to utilize other controllers in parallel or series with the described controller. Some examples of such controllers are proportional, derivative, integral controllers and combinations of these.

Figure 9:
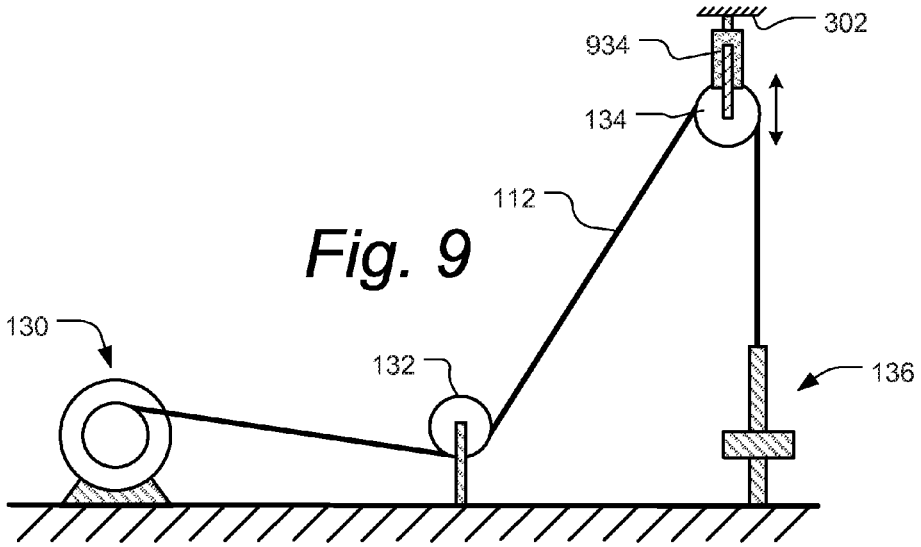
FIG. 9 illustrates a system having an actuator generate force or displacement on the wireline cable for reducing axial wave reflections, according to some embodiments.
Figure 7A:
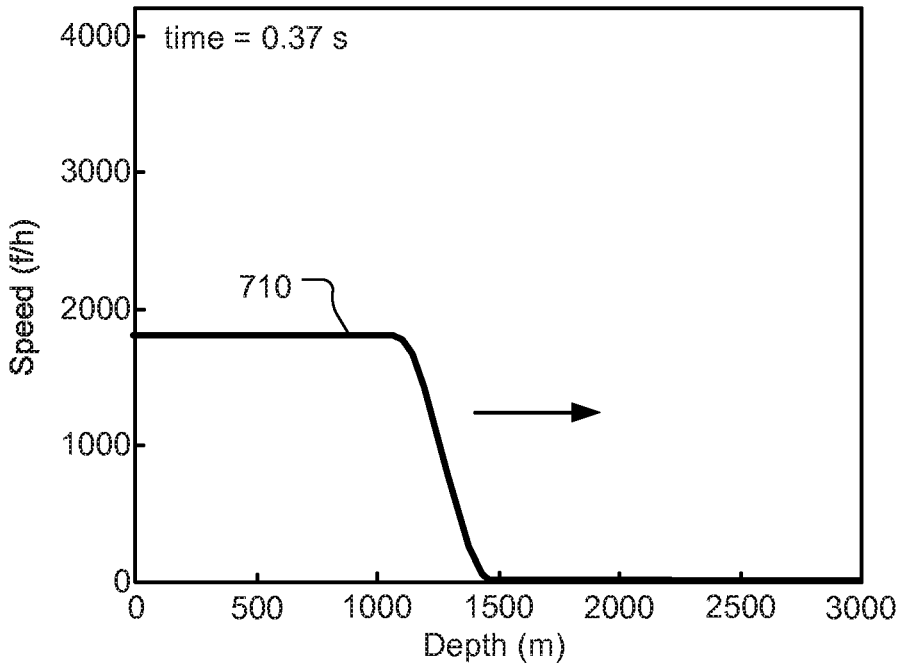
FIGS. 7A-D and FIGS. 8A-D are plots showing the simulation results for a surface velocity that is rapidly imposed at the surface, according to some embodiments
Figure 7B:
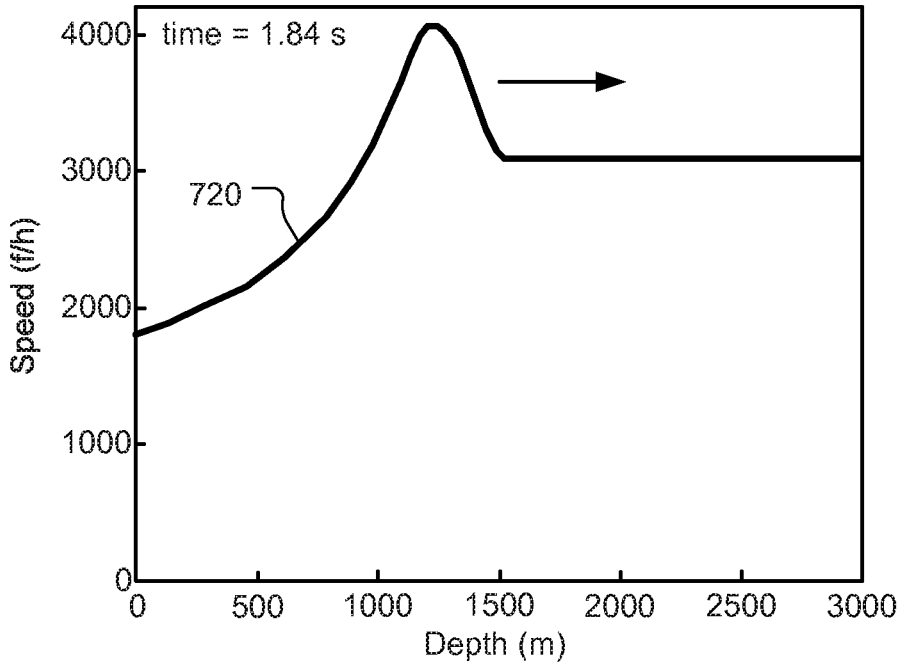
Figure 7C:
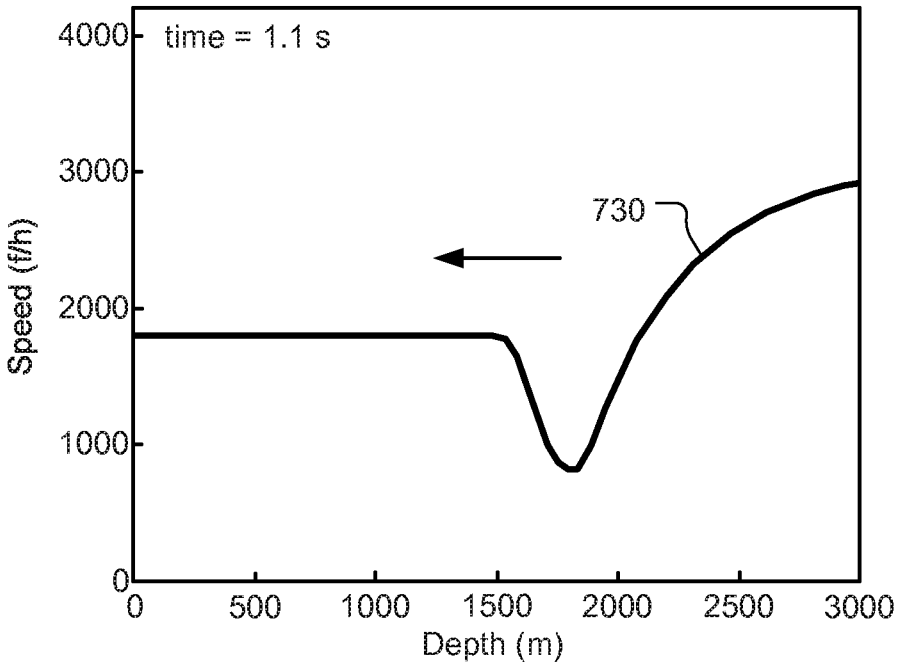
Figure 7D:
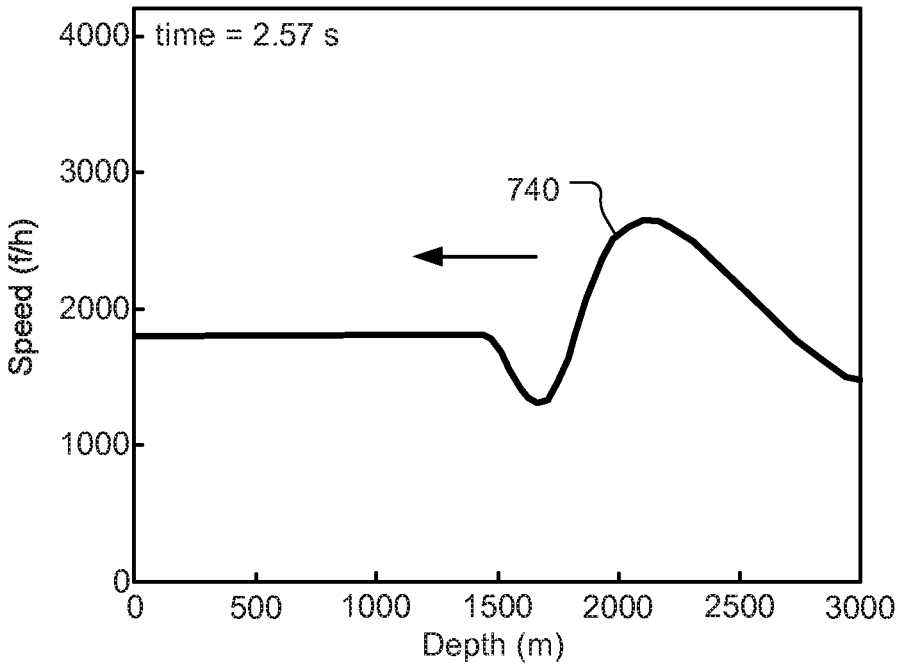
Figure 8A:
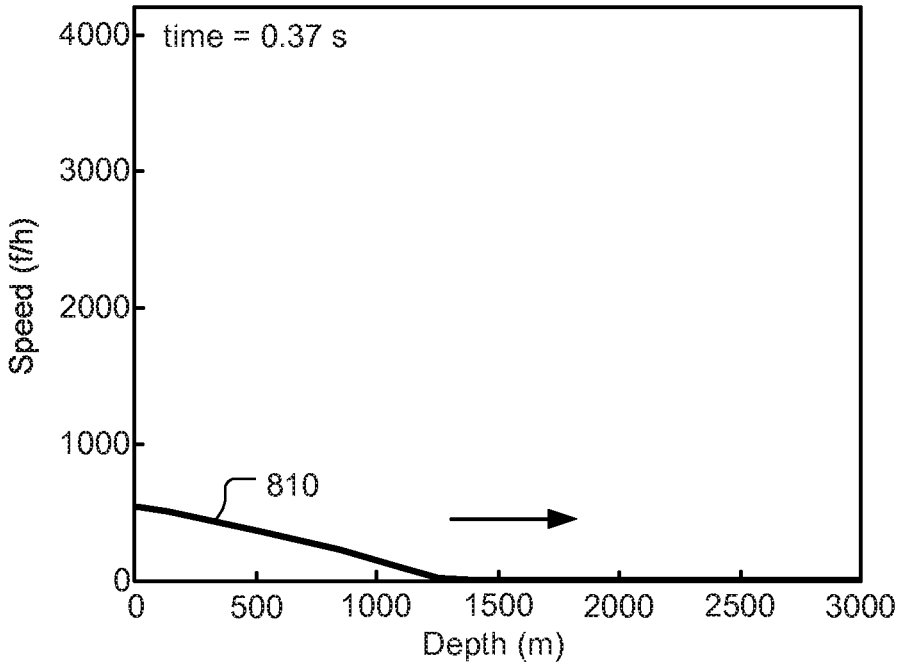
Figure 8B:
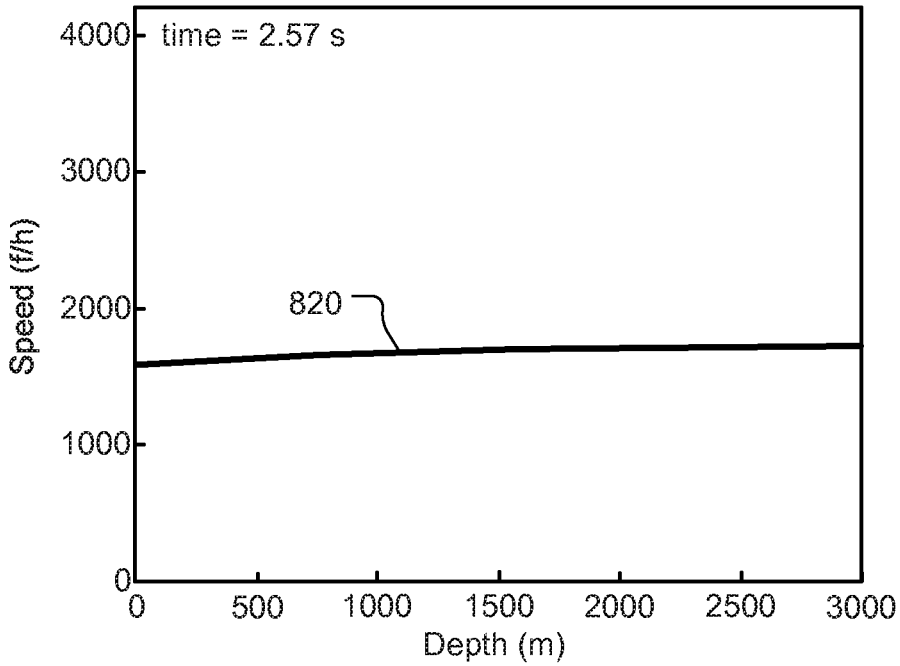
Figure 8C:
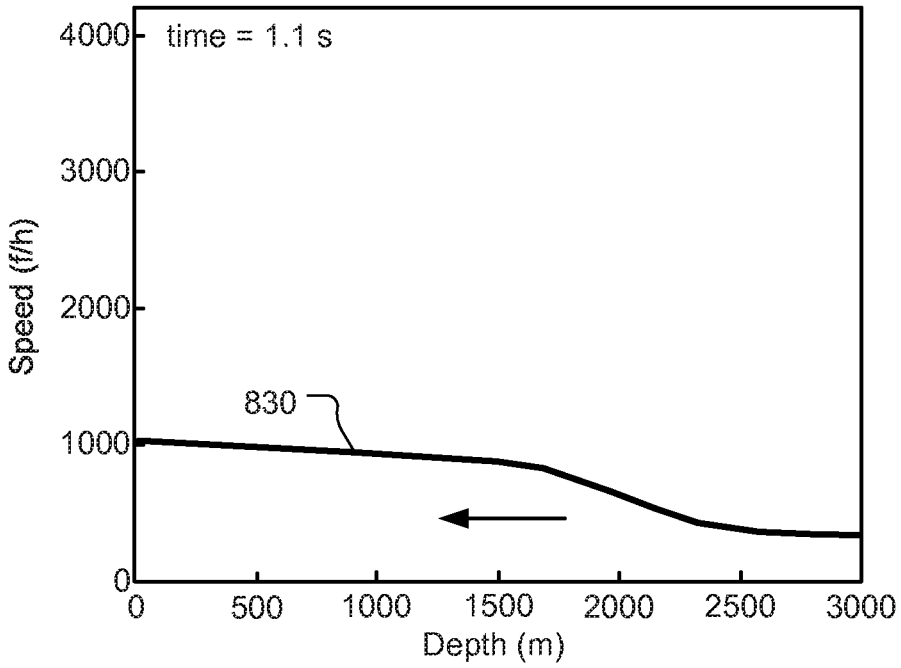
Figure 8D:
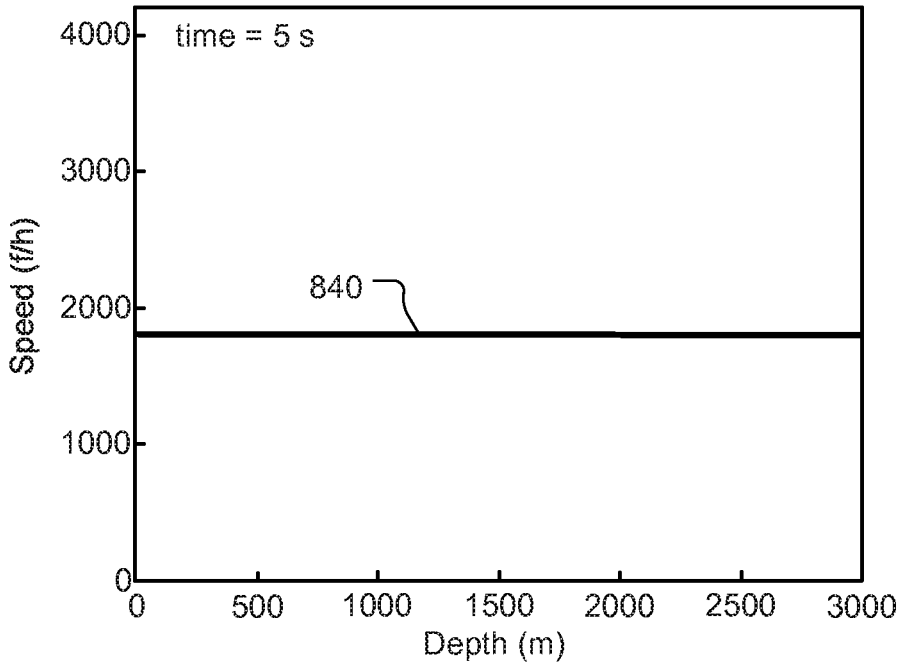

According to some alternate embodiments, one or more actuators are placed that can generate a force or displacement on the wireline cable or logging tool. FIG. 9 illustrates a system having an actuator to generate force or displacement on the wireline cable for reducing axial wave reflections, according to some embodiments. In particular, the control system includes an actuator 934 placed between the upper sheave 134 and the ground frame 302. Although this actuator 934 is shown for the upper sheave 134, according to other embodiments it can be placed between the ground frame and another sheave or the winch. This actuator 934 may be a linear or a rotational actuator.

FIG. 10 illustrates a system having an actuator placed between the cable and the logging tool, according to an alternate embodiment. Also shown in FIG. 10 is a cable mounted tension monitoring device 1036, and according to some alternative embodiments, a motion sensor can also be included in either device 136, actuator 1034 or toolstring 116. According to some embodiments, including those in FIGS. 9 and 10, one or more of the following types of actuators may be used: hydraulic damper, variable orifice hydraulic damper, hydraulic actuator, pneumatic actuator, magnetorheological damper, electrorheological damper, linear motor, spring, and rotational motor with a lead screw (or ball screw).

Figure 11A:
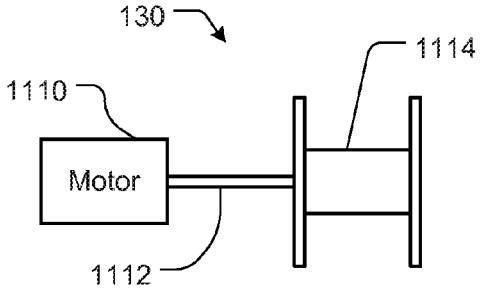
FIGS. 11A and 11B illustrate the placement of a torsional actuator in the driveline that connects the torque generating unit and the wireline drum, according to some embodiments.
Figure 11B:
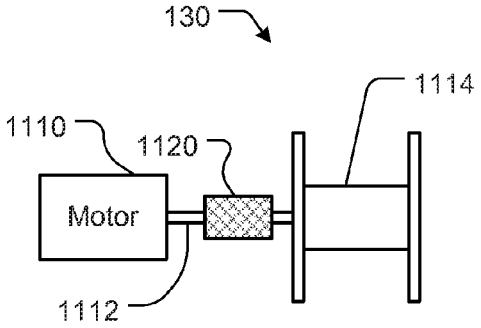

FIGS. 11A and 11B illustrate the placement of a torsional actuator in the driveline that connects the torque generating unit and the wireline drum, according to some embodiments. FIG. 11A shows a winch system 130 in which a hydraulic motor 1110 is used to provide the torque to drive the drum 1114. Other transmission and speed reduction elements that are not shown in FIGS. 11A and 11B are commonly present between the motor and drum, such as a gearbox or a chain-and-sprockets. According to the embodiment shown in FIG. 11B, a torsional actuator 1120 is placed in the driveline 1112 to provide cable actuation. According to some embodiments, actuator 1120 may include one or more of the following: a magnetorheological clutch, an electrorheological clutch, a friction clutch, an electromagnetic brake, an electromagnetic motor, and/or a torsional spring.

According to some embodiments further techniques identifying the sticking of the cable will now be described. The system includes a surface actuator and a sensor. The actuator generates an axial wave on the wireline cable which travels down the cable. In an ideal operation, the wave is effectively not reflected until it reaches the wireline tool. However, if there is sticking of the cable, a reflection can also occur at the location of sticking This shift in the transmission of the wave on the wireline cable is used to identify the onset and/or presence of sticking.

Figure 12:
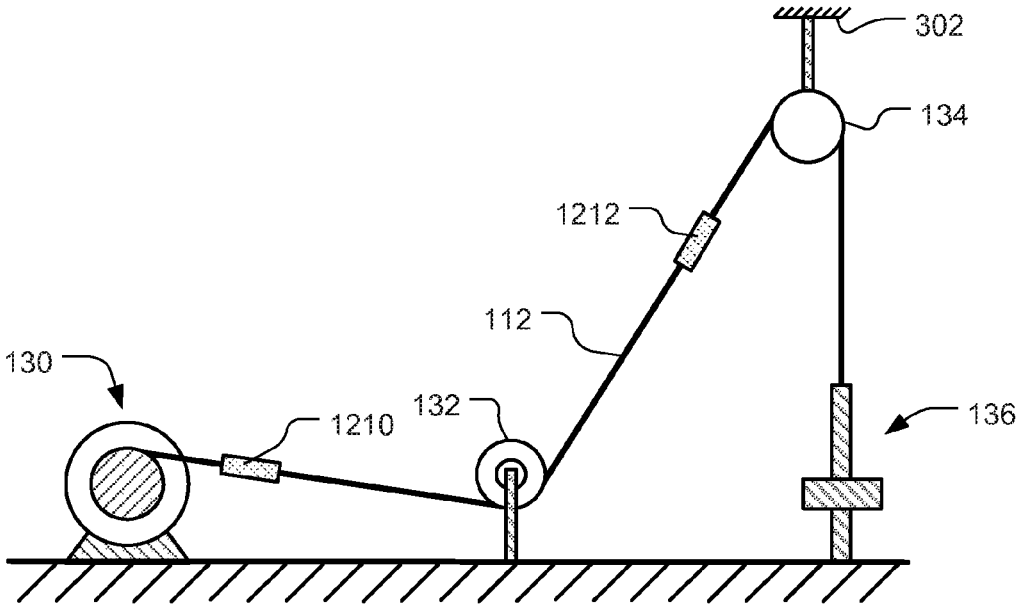
FIG. 12 illustrates a system for detecting the onset and/or presence of wireline cable sticking, according to some embodiments.

According to some embodiments, transmission characteristics of an axial mechanical wave on the wireline cable are utilized to sense the presence of cable sticking The axial wave is generated by an actuator located at the surface. FIG. 12 illustrates a system for detecting the onset and/or presence of wireline cable sticking, according to some embodiments. Winch 130 is used to deploy a wireline tool downhole via wellhead 136 using cable 112, lower sheave 132 and upper sheave 134. An axial wave is generated by an on-cable tension generating actuator 1210. To identify the transmission of the axial wave a sensor is utilized. According to some embodiments, an on-cable tension sensing device 1212 is used. This device 1212 can be a CMTD as described further in US Patent Application Publ. No. 2010/0262384.

Figure 13:
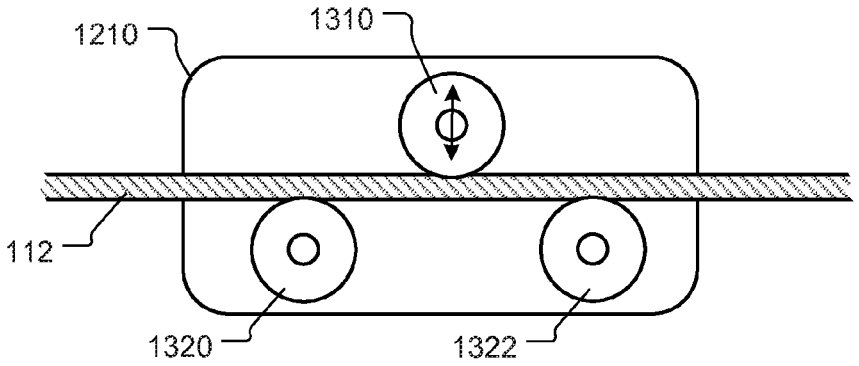
FIG. 13 is a schematic diagram of an on-cable generating actuator, according to some embodiments.
Figures 14A, 14B, 14C, 14D:
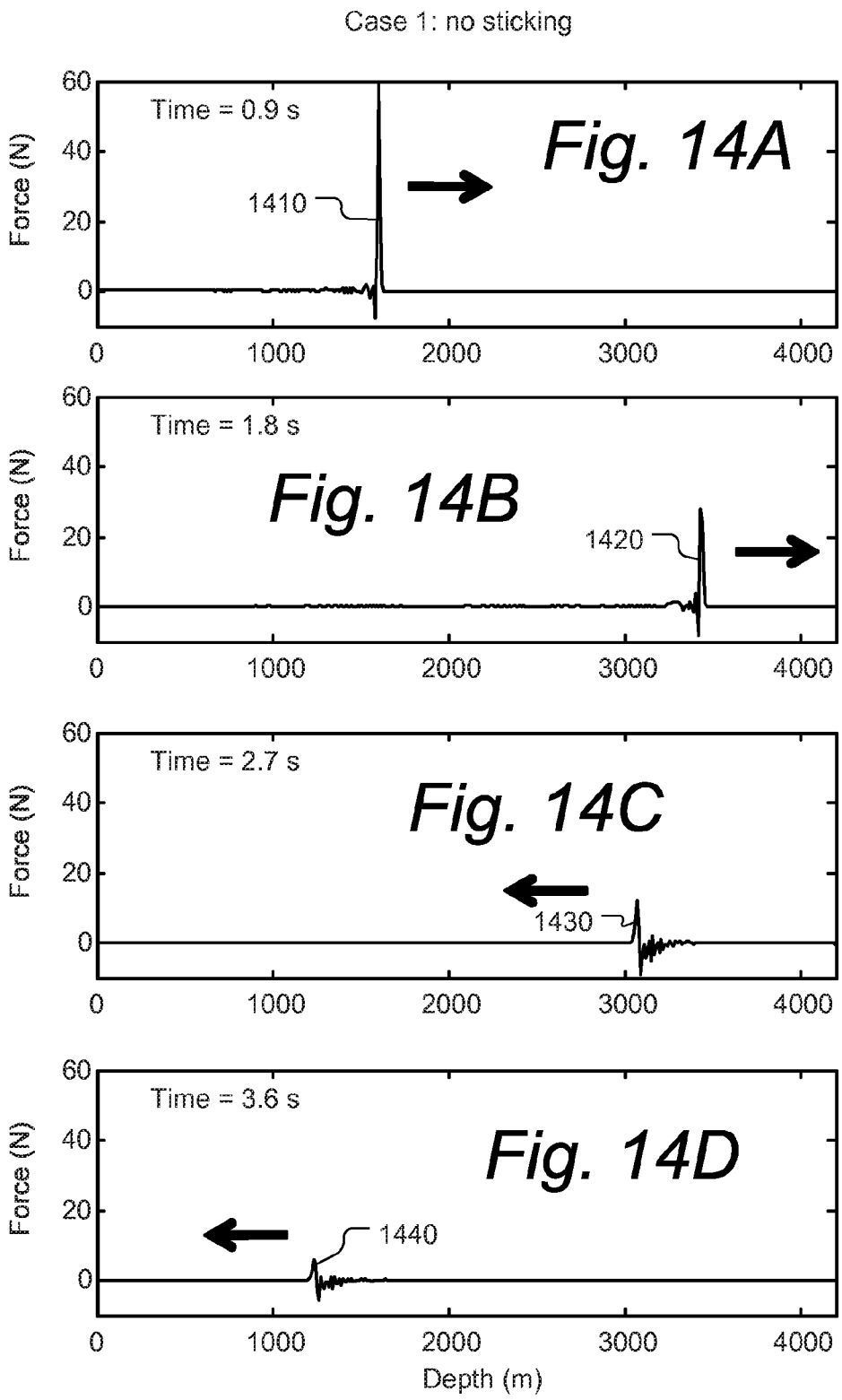
FIGS. 14A-D and 15A-D are plots of simulated data illustrating the transmission of axial waves on a wireline cable, according to some embodiments.
Figures 15A, 15B, 15C, 15D:
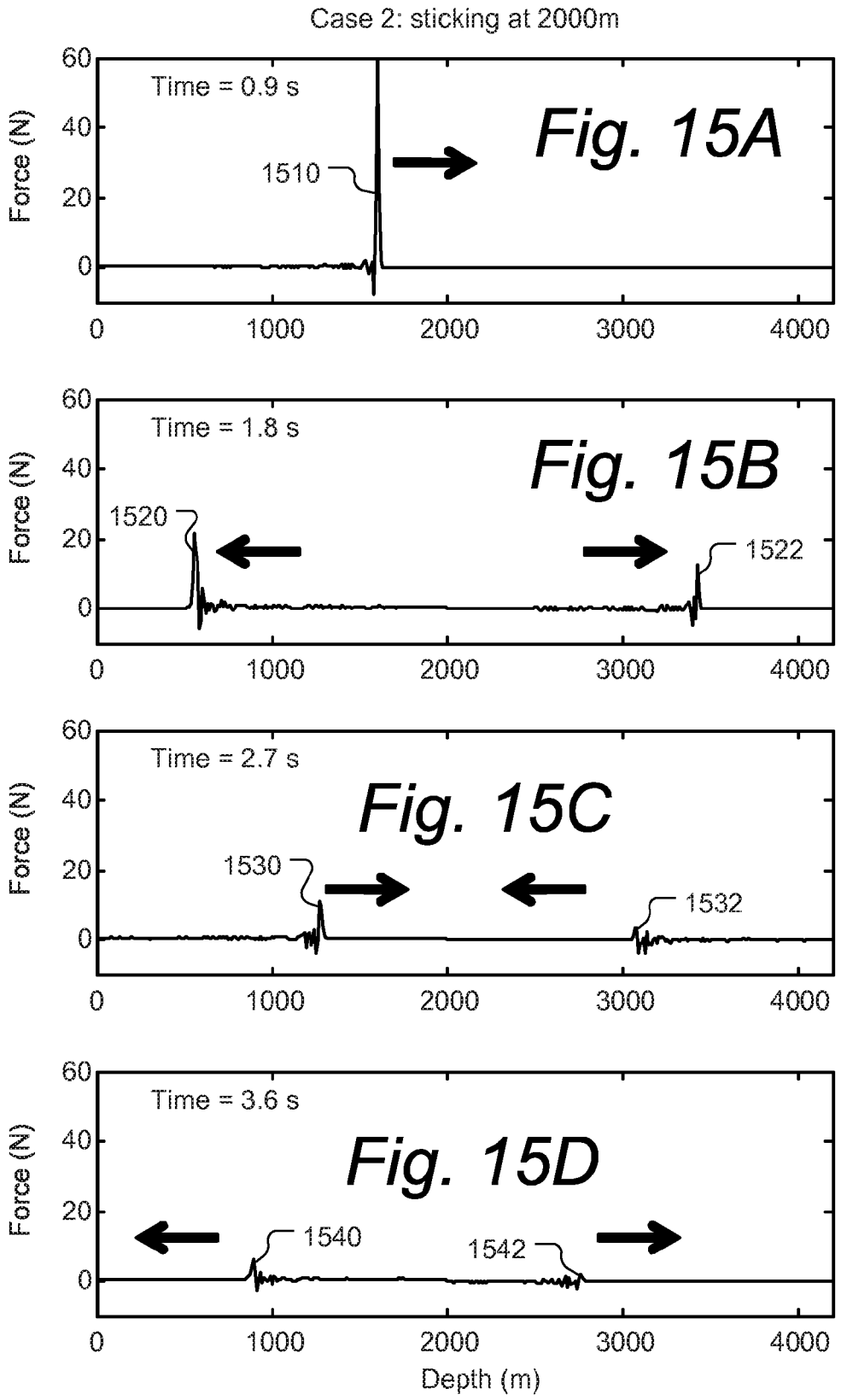

FIG. 13 is a schematic diagram of an on-cable generating actuator, according to some embodiments. The actuated roller 1310 can be articulated towards or away from the wireline cable 112, which is supported by idler rollers 1320 and 1322, to generate a tension pulse on the cable.

FIGS. 14A-D and 15A-D are plots of simulated data illustrating the transmission of axial waves on a wireline cable, according to some embodiments. Tension force is plotted as a function of depth. In FIGS. 14A-D, it can be seen from plots 1410, 1420, 1430 and 1440 that the axial disturbance generated at the surface travels down the cable and reflects from the wireline tool. In contrast, in FIGS. 15A-D, differential sticking is simulated at 2000m. In plots 1510, 1520, 1530 and 1540, the wave traveling down the cable partially reflects from the sticking site, giving a signature that can either be measured at the surface or at the tool location to determine the sticking.

Figure 16:
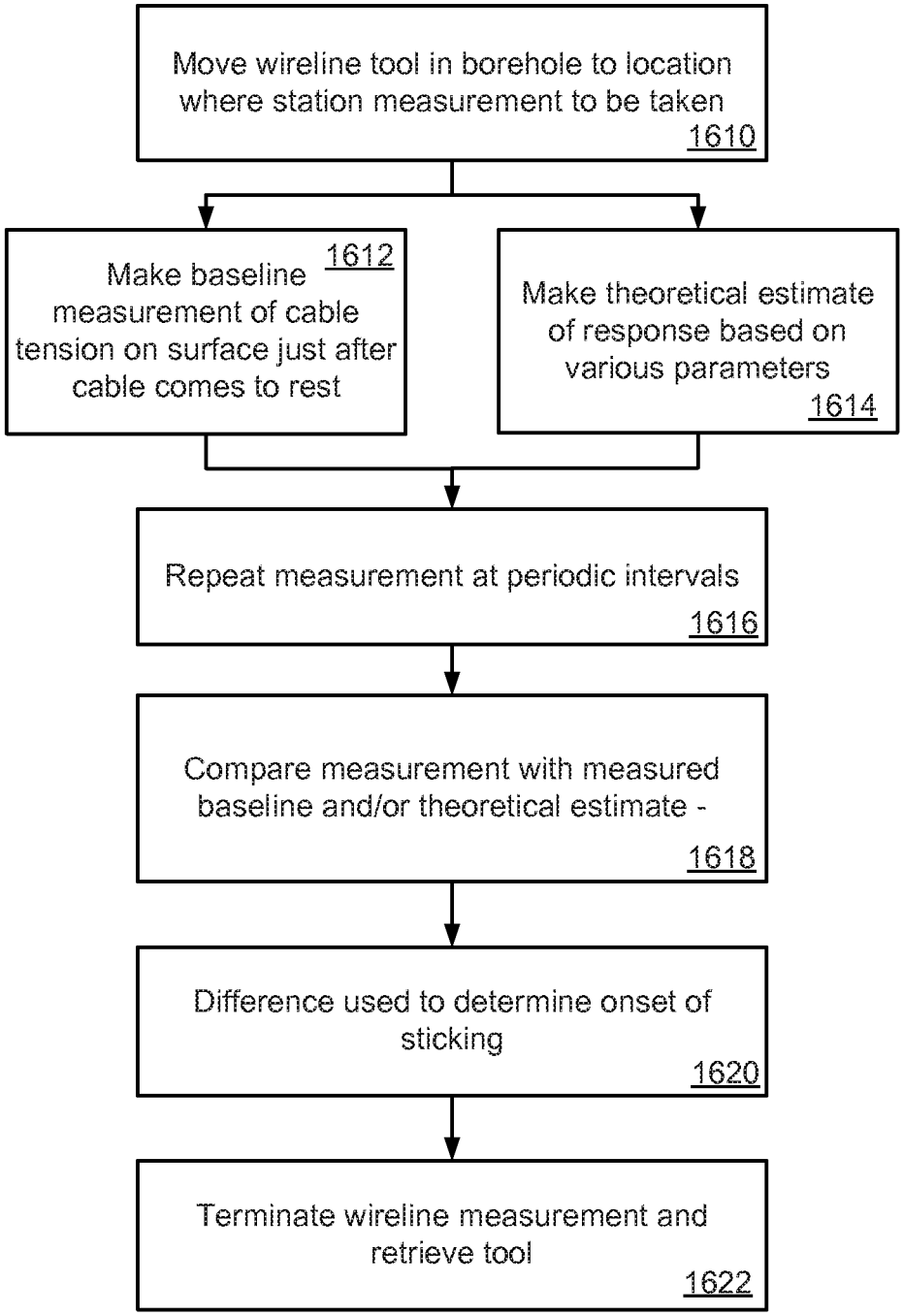
FIG. 16 is a flow chart showing processes in determining the presence of cable sticking, according to some embodiments.

Thus, according to some embodiments, the difference between the tension sensed at the surface is used to determine the presence of cable sticking. This can be achieved in at least two ways which are shown in FIG. 16. FIG. 16 is a flow chart showing processes in determining the presence of cable sticking, according to some embodiments. In process 1610, the wireline tool is moved in the borehole to bring it to the location where the wireline tool station measurement is to be taken. Upon reaching this location the wireline cable and tool comes to a rest. According to one embodiment, at process 1612, just as the tool comes to rest an axial wave is generated and a baseline measurement of surface tension in response to this excitation is measured. Since the differential sticking phenomenon develops over time, a measurement taken right after the system comes to rest may be assumed to be free of reflection caused by sticking In process 1616 axial wave generation and measurement is repeated at periodic intervals. In process 1618, following each periodic measurement the measurement is compared with the baseline. In process 1620, if a difference in the reflection is measured, this can potentially be interpreted as caused by sticking. In process 1622, the wireline measurement is terminated and the wireline tool is retrieved. According to an alternative embodiment, no baseline measurement is required. In this embodiment, in process 1614, a theoretically estimated response is determined based on parameters such as the depth of the tool, wave speed, fluid viscosity, etc. Again the sticking is determined if there is a difference between the measured reflection and the modeled (theoretical) reflection.

According to some alternative embodiments, possible locations of the actuator in alternate embodiments are as follows with reference to FIG. 3: a translational actuator on wireline winch 130, lower sheave 132, and upper sheave 134, torsional actuator on wireline winch 130, lower sheave 132 and upper sheave 134, and on-cable tension generation actuator.

According to some embodiments, the presence of the axial wave can be detected by utilizing a force or a motion (displacement, velocity or acceleration) transducer. In some cases a force transducer may be preferable in order to achieve the required resolution in the measurement. Some possible locations for the transducer in alternate embodiments are: force sensor on wireline winch 130, lower sheave 132, and upper sheave 134, rotation motion sensor on wireline winch 130, an on-cable tension sensor on cable 112, rotational motion sensor on upper sheave 134 and lower sheave 132, translational motion sensor on the wireline tool, and force sensor on wireline tool. In particular, according to some embodiments, a force sensor can be located on the wireline tool, or just above it, such as elements 1034 or 1036 in FIG. 10. According to these embodiments, the axial wave is initiated on the surface and the wave is sensed at the tool. By detecting a difference between the currently sensed wave and a baseline measurement (and/or a theoretical baseline), the onset of cable sticking can be detected.

According to some embodiments, techniques for inhibiting or retarding cable sticking will now be described in greater detail. Referring again to FIG. 12, the system shown can be used for retarding the processes that lead to differential sticking of a wireline cable, according to some embodiments. The system utilizes a surface actuator 1210 to generate an axial tension wave on the cable 112 which propagates on the cable. This actuator 1210 is activated during wireline station measurements and the cable which is at rest during the measurement is moved slightly as the axial waves propagate on the cable 112, disallowing a differential pressure to build. According to some embodiments, various profiles of tension waves can be generated such as sinusoidal, trapezoidal, triangular, etc. According to some embodiments, possible locations of the actuator include: a translational actuator on wireline winch 130, lower sheave 132, and upper sheave 134, torsional actuator on wireline winch 130, lower sheave 132 and upper sheave 134 and on-cable tension generation actuator.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wood parts together, whereas a screw employs a helical surface, in the environment of fastening wood parts, a nail and screw may be equivalent structures. It is the express intention of the applicant not to invoke 35 U.S.C. §112, paragraph 6 for any limitations of any of the claims herein, except for those in which the claim expressly uses the words "means for" together with an associated function.

What is claimed is:

1. A method of detecting sticking of a wireline tool cable deployed in a borehole, the method comprising:

deploying a wireline tool in a borehole using a cable;

using an actuator to induce an axial wave propagating along the cable;

making measurements of reflections or transmissions of the induced axial wave; and detecting a parameter relating to sticking of the cable within the borehole based at least in part on the measurements.

2. The method according to claim 1 wherein said measurements are made on a wellbore surface.

3. The method according to claim 1 wherein the measurements of the induced axial wave are made downhole at or near the wireline tool.

4. The method according to claim 1 wherein the detected parameter relating to sticking is onset of sticking.

5. The method according to claim 1 wherein the detected parameter relating to sticking is location of sticking.

6. The method according to claim 1 further comprising:

making a baseline measurement of surface tension following a recent repositioning of the wireline tool within the borehole; and comparing subsequent measurements to the baseline measurement, wherein the detecting is based in part on the comparison.

7. The method according to claim 1 wherein the detecting includes comparing the measurements with a calculated expected value based at least on the depth of the tool and at least one cable parameter.

8. The method according to claim 1 wherein the axial wave is induced using the actuator located on the surface.

9. The method according to claim 1 wherein the measurements are made using a sensor located on the surface.

10. The method according to claim 1 further comprising actuating the cable so as to inhibit sticking.

11. The method according to claim 1 wherein the actuator is located on the surface.

12. The method according to claim 1 wherein the actuator induces an axial oscillatory motion along the cable.

13. A system for detecting sticking of a wireline tool cable deployed in a borehole, the system comprising:

a wireline tool;

a wireline cable adapted for deployment of the tool in a borehole;

an actuator adapted and connected so as to induce an axial wave propagating along the cable;

a measurement system adapted to make measurements of reflections or transmissions of the induced axial wave; and a processing system adapted and programmed to detect onset of sticking of the cable within the borehole based at least in part on the measurements.

14. The system according to claim 13 wherein the measurement system is located downhole and is adapted to make measurements of the induced axial wave transmitted along the cable.

15. The system according to claim 13 wherein the actuator and measurement system are located on the surface.

* * * * *